US011920825B2

(12) United States Patent
Zhang

(10) Patent No.: US 11,920,825 B2
(45) Date of Patent: Mar. 5, 2024

(54) HUMIDIFYING DEVICE

(71) Applicant: Shenzhen Chenbei Technology Co., Ltd., Shenzhen (CN)

(72) Inventor: Yixiong Zhang, Shenzhen (CN)

( * ) Notice: Subject to any disclaimer, the term of this patent is extended or adjusted under 35 U.S.C. 154(b) by 73 days.

(21) Appl. No.: 17/705,279

(22) Filed: Mar. 26, 2022

(65) Prior Publication Data

US 2022/0307707 A1 Sep. 29, 2022

(30) Foreign Application Priority Data

Mar. 26, 2021 (CN) ..... 202110327496.3

(51) Int. Cl.

| | |
|---|---|
| ***F24F 6/04*** | (2006.01) |
| ***F24F 1/02*** | (2019.01) |
| ***F24F 6/00*** | (2006.01) |
| ***F24F 8/117*** | (2021.01) |
| ***F24F 13/28*** | (2006.01) |

(52) U.S. Cl.

CPC ..... *F24F 6/043* (2013.01); *F24F 1/02* (2013.01); *F24F 8/117* (2021.01); *F24F 13/28* (2013.01); *F24F 2006/006* (2013.01); *F24F 2006/008* (2013.01); *F24F 2221/36* (2013.01)

(58) Field of Classification Search

CPC ..... F24F 6/12; F24F 6/18

See application file for complete search history.

(56) References Cited

U.S. PATENT DOCUMENTS

| | | | | |
|---|---|---|---|---|
| 2,872,858 A * | 2/1959 | Caldwell | F24F 3/0522 165/59 |
| 2019/0029921 A1* | 1/2019 | Liang | A61H 33/065 |

* cited by examiner

*Primary Examiner* — Schyler S Sanks

(74) *Attorney, Agent, or Firm* — Tsz Lung Yeung

(57) ABSTRACT

This application relates to a humidifying device, including a shell, an air duct and an air blowing apparatus disposed in the shell, wherein a mist outlet channel, an atomizing cavity and a heating cavity communicated with the mist outlet channel are disposed in the shell; the air duct includes a first air duct communicated with the atomizing cavity and a second air duct communicated with the heating cavity; the air blowing apparatus is provided with an air outlet member, and the air outlet member is aligned with the first air duct and the second air duct, and is configured to supply a first air flow to the first air duct and supply a second air flow to the second air duct. When the humidifying device operates, the first air flow forms an atomized air flow and the second air flow forms a heated air flow then are mixed.

12 Claims, 9 Drawing Sheets

HUMIDIFYING DEVICE

CROSS REFERENCE

This is a non-provisional application which claims priority to a Chinese patent application having an application number of CN202110327496.3, and a filing date of Mar. 26, 2021, the entire contents of which is hereby incorporated by reference.

TECHNICAL FIELD

This application relates to the technical field of household electrical appliances, and in particular, to a humidifying device.

BACKGROUND

A humidifying device in the conventional technologies includes an atomizing groove and a heating groove. The atomizing groove atomizes water to form water mist, the heating groove heats water to form water steam, and the water mist and the water steam are further mixed to form hot mist, to be then sprayed out from the humidifying device.

However, in the conventional technologies, only air is blown above the atomizing groove, so that the heated water steam generated in the heating groove cannot be well mixed with the atomized gas to heat the water mist, which makes the water mist heating efficiency of the humidifying device low, resulting in the defects of slow hot mist discharge, less hot mist discharge, and poor humidifying effect.

SUMMARY

An objective of the application lies in providing a humidifying device with fast hot mist discharge, large amount of hot mist discharge and good humidifying effect.

Embodiments of this application provide a humidifying device, including a shell, wherein a mist outlet channel, an atomizing cavity and a heating cavity communicated with the mist outlet channel are disposed in the shell; an air duct, disposed in the shell and including a first air duct communicated with the atomizing cavity and a second air duct communicated with the heating cavity; an air blowing apparatus, disposed in the shell and provided with an air outlet member for outflow of an air flow, wherein the air outlet member is configured to provide a first air flow to the first air duct and a second air flow to the second air duct, wherein when the humidifying device operates, the first air flow enters the atomizing cavity through the first air duct to form an atomized air flow, the second air flow enters the heating cavity through the second air duct to form a heated air flow, and then the atomized air flow and the heated air flow enter the mist outlet channel, and are mixed in the mist outlet channel and sprayed out from the humidifying device.

In an embodiment, the air outlet member is provided with at least one first air outlet and at least one second air outlet, the first air outlet is disposed aligned with the first air duct and configured to provide the first air flow to the first air duct, and the second air outlet is disposed aligned with the second air duct and configured to provide the second air flow to the second air duct.

In an embodiment, the air outlet member extends into the air duct, the air duct is separated by the air outlet member to form the first air duct and the second air duct, the first air outlet faces a side where the first air duct is located, and the second air outlet faces a side where the second air duct is located.

In an embodiment, an opening size of the first air outlet is greater than an opening size of the second air outlet.

In an embodiment, the humidifying device further includes a seat and a water tank, wherein the water tank is disposed on the seat, and the seat is provided with an atomizing groove forming a partial space of the atomizing cavity and a heating groove forming a partial space of the heating cavity; openings of the atomizing groove and the heating groove all face a side where the water tank is located; and the air outlet member protrudes from a side of the seat facing the water tank.

In an embodiment, the water tank is provided with a bottom wall of the water tank near the side where the seat is located, the bottom wall of the water tank is provided with at least two spaced air duct partitions protruding toward the side where the seat is located, and the air duct partitions and a wall surface of the seat facing the air duct partitions jointly form the air duct.

In an embodiment, the air blowing apparatus further includes a waterproof component, the waterproof component includes a waterproof member and an elastic support member, and the waterproof member is supported on the elastic support member and covers an air outlet of the air outlet member for air discharging; the waterproof member is movable under a force to open the air outlet and enable the elastic support member to be deformed; and after the force applied to the waterproof member is removed, the elastic support member recovers deformation to drive the waterproof member to move until covering the air outlet.

In an embodiment, the waterproof member includes a waterproof portion for covering an air outlet position of the air outlet member and a connection portion connected to a side of the waterproof portion; one end of the elastic support member is abutted on the seat, and the other end of the elastic support member is abutted on the connection portion; and the waterproof component further includes a guide member, wherein the guide member is disposed around an outer side of the elastic support member.

In an embodiment, the humidifying device further includes a cover disposed on the heating groove, and an inner wall of the heating groove and the cover jointly form the heating cavity; and the cover is provided with a first opening and a second opening, wherein the first opening is communicated with the second air duct, and the second opening is communicated with the mist outlet channel.

In an embodiment, a wall surface of the cover far away from the heating groove is a top wall of the cover, and the second opening is disposed on the top wall of the cover; and the top wall of the cover is provided with a surrounding portion disposed around the second opening, and the surrounding portion is disposed obliquely relative to a vertical direction; or the top wall of the cover entirely is disposed obliquely relative to a vertical direction.

In an embodiment, the atomizing groove is further provided with a muffler; and the muffler is funnel-shaped, a smaller opening of the funnel-shaped muffler is a fourth opening, a larger opening of the muffler is a fifth opening, the fourth opening is aligned with the opening of the atomizing groove, and the fifth opening is communicated with the mist outlet channel.

In an embodiment, the muffler has a circumferential sidewall, at least part of which is located inside the air duct, a first ventilation hole is provided on the circumferential sidewall located inside the air duct, and the first air duct is internally communicated with the muffler through the first ventilation hole.

In an embodiment, the seat is further provided with a water groove and a communication groove, the water groove is configured to supply water to the heating groove, the communication groove communicates the heating groove and the water groove, and the communication groove is further provided with a water level measurement apparatus configured to measure a water level in the communication groove.

In an embodiment, a water barrier component is disposed in the communication groove, the water barrier component includes at least two water barriers, the water barriers are arranged at intervals along an extending direction of the communication groove, and one end of each water barrier near a bottom of the communication groove is provided with a water passing hole for water to flow through; and the water level measurement apparatus is disposed between two adjacent water barriers.

The beneficial effects of this application are: the humidifying device of this application is provided with a second air duct communicated with the heating cavity, to enable the humidifying device to have an independent air duct to blow out the water steam generated by heating at the heating cavity to the mist outlet channel, so that the water mist atomized in the atomizing cavity can be quickly heated when the humidifying device starts operating, that is, the hot mist can be quickly discharged. At the same time, there is a large amount of hot mist in the continuous operating process of humidifying device. In addition, because the air duct is further provided with a first air duct communicated with the atomizing cavity, the air flow from the air outlet member does not appear turbulence, and the water steam and water mist can be quickly mixed, so that the mist discharge efficiency is high.

BRIEF DESCRIPTION OF THE DRAWINGS

To explain the embodiments of the present invention or the technical solutions of the prior art more clearly, the accompanying drawings to be used in the description of the embodiments or the prior art will be briefly described below. Clearly, the accompanying drawings in the following description are only some embodiments of the present invention, and a person of ordinary skill in the art may further obtain other drawings based on these accompanying drawings without creative efforts.

Figure 1:
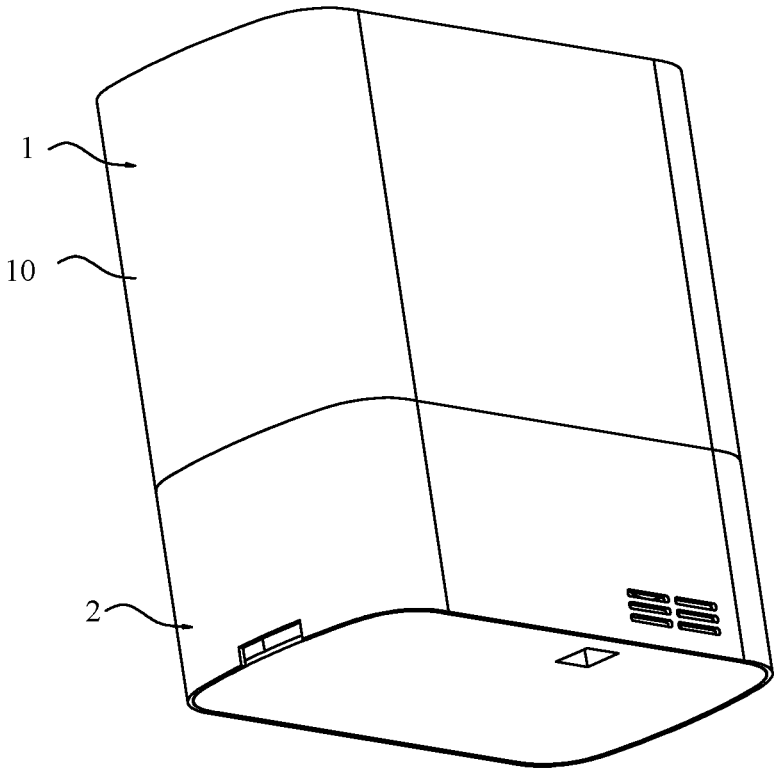
FIG. 1 is a schematic diagram of the overall structure of a humidifying device according to a first embodiment of the present invention, wherein the humidifying device includes a water tank and a seat.

Symbol Description of Main Elements:

Water tank 1, shell 10, mist outlet channel 11, seat 2, raised wall 21, atomizing cavity 3, atomizing groove 31, first side 311, muffler 32, fourth opening 321, fifth opening 322, circumferential sidewall 323, first ventilation hole 324, baffle 325, second ventilation hole 326, fixing plate 327, extension plate 328, heating cavity 4, heating groove 41, second side 411, cover 42, first opening 421, second opening 422, third opening 423, top wall of the cover 424, cover circumferential wall 425, steam outlet 426, surrounding portion 427, air duct 5, first air duct 51, second air duct 52, air duct partition 53, second section 55, first section 54, transition surface 56, support plate 57, notch 58, air blowing apparatus 6, air outlet member 61, first air outlet 611, second air outlet 612, waterproof component 62, waterproof member 63, waterproof portion 631, connection portion 632, guide section 633, first guide hole 634, second guide hole 635, elastic support member 64, guide member 65, limit member 66, water groove 7, communication groove 8, water barrier component 81, water barrier 82, water passing hole 83, mounting member 84, mounting groove 85, and water level measurement apparatus 86.

DETAILED DESCRIPTION OF THE PREFERRED EMBODIMENT

For easy understanding of this application, a more complete description of this application will be given below with reference to the associated drawings. Preferred embodiments of the present invention are given in the drawings. However this application can be implemented in many different forms and is not limited to the embodiments described herein. On the contrary, the embodiments are provided for a more thorough understanding of the content recited in this application.

It should be noted that when an element is called "fixed" to another element, it can be directly on the other element or there can also be a centered element. When an element is considered to be "connected" to another element, it may be directly connected to the other element or may be accompanied by a centering element. The terms "vertical", "horizontal", "left", "right" and similar expressions used herein are for illustrative purposes only.

Unless otherwise defined, all technical and scientific terms used herein have the same meaning as would normally be understood by those skilled in the art of this application. The terms used in this application are only for describing specific embodiment, and are not intended to limit this application. The term "and/or" as used herein includes any and all combinations of one or more of the related listed items.

Referring to FIG. 1-FIG. 18, this application provides a humidifying device, the humidifying device mainly realizes the purpose of humidifying by spraying. Therefore, the humidifying device in this embodiment can also be other devices for realizing the purpose of humidifying by using the spraying principle.

The humidifying device of this application includes a shell 10, and an air duct 5 and an air blowing apparatus (not shown) disposed in the shell 10. A mist outlet channel 11, and an atomizing cavity 3 and a heating cavity 4 communicated with the mist outlet channel 11 are disposed in the shell 10. The air duct 5 includes a first air duct 51 communicated with the atomizing cavity 3 and a second air duct 52 communicated with the heating cavity 4. The air blowing apparatus is provided with an air outlet member 61 for outflow of an air flow, and the air outlet member 61 is aligned with the first air duct 51 and the second air duct 52, and is configured to supply a first air flow to the first air duct 51 and supply a second air flow to the second air duct 52.

When humidifying device operates, the first air flow enters the atomizing cavity 3 through the first air duct 51 to form an atomized air flow, the second air flow enters the heating cavity 4 through the second air duct 52 to form a heated air flow, and then the atomized air flow and the heated air flow enter the mist outlet channel 11, and are mixed in the mist outlet channel 11 and sprayed out from the humidifying device.

It should be noted that the atomizing cavity 3 atomizes water to generate water mist, and the first air flow enters the atomizing cavity 3 and is mixed with the water mist to form an atomized air flow; the heating cavity 4 heats water to generate water steam, and the second air flow enters the heating cavity 4 and is mixed with the water steam to form a heated air flow.

The humidifying device of this application is provided with a second air duct 52 communicated with the heating cavity 4, to enable the humidifying device to have an independent air duct to blow out the water steam generated by heating at the heating cavity 4 to the mist outlet channel 11, so that the water mist atomized in the atomizing cavity 3 can be quickly heated when the humidifying device starts operating, that is, the hot mist can be quickly discharged. At the same time, there is a large amount of hot mist in the continuous operating process of humidifying device. In addition, because the air duct 5 is further provided with a first air duct 51 communicated with the atomizing cavity 3, the air flow from the air outlet member 61 does not appear turbulence, and the water steam and water mist can be quickly mixed, so that the mist discharge efficiency is high. Moreover, because the air flow from the air outlet 61 does not have turbulence, the temperature uniformity of the mist discharged from the humidifying device is better.

The humidifying device of this application is described below in four embodiments.

An embodiment of this application provides a humidifying device according to a first embodiment.

Figure 2:
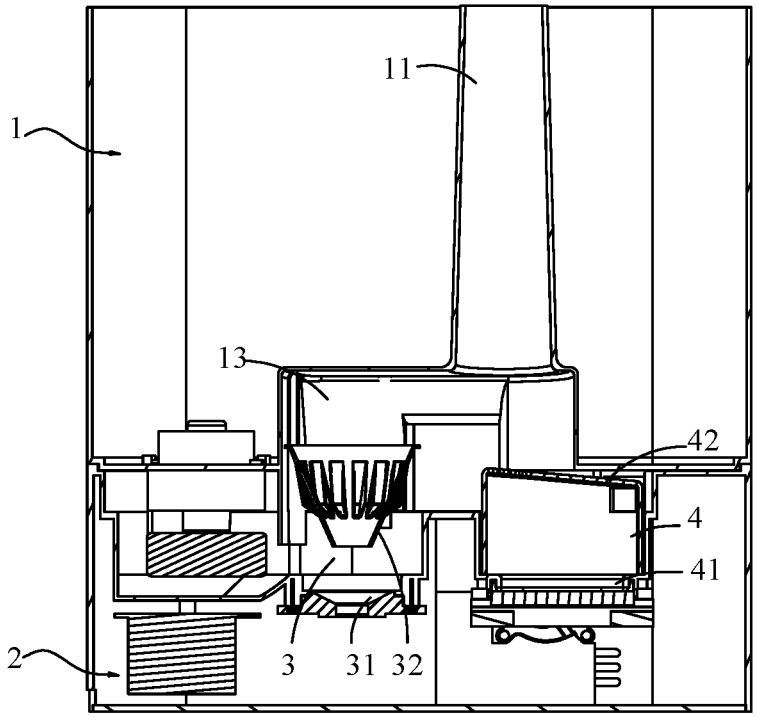
FIG. 2 is a sectional view of FIG. 1.
Figure 4:
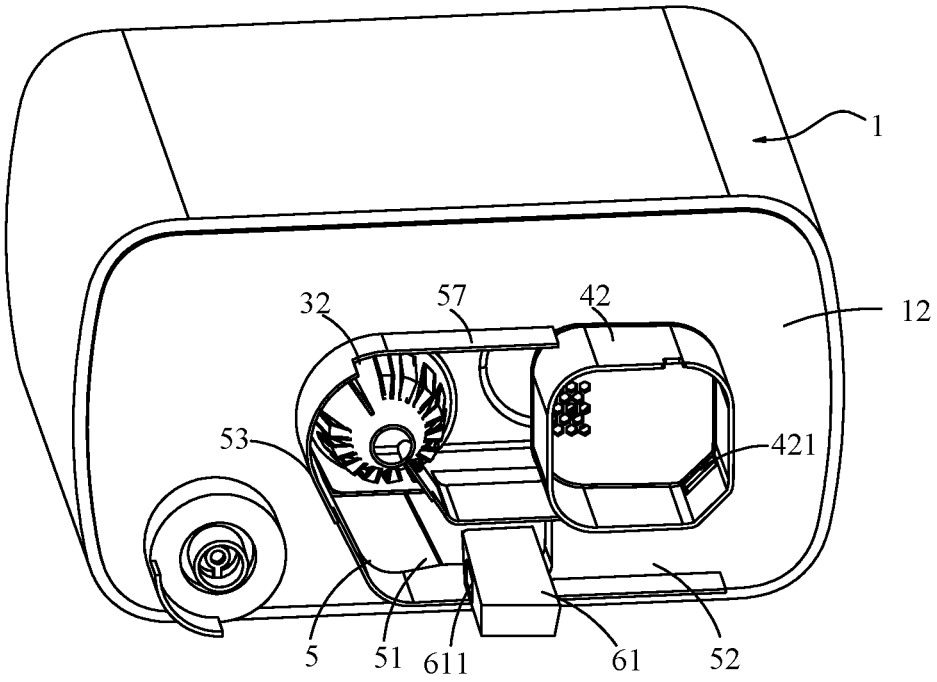
FIG. 4 is a schematic diagram of a partial structure of the humidifying device including the water tank as illustrated in FIG. 3.

Referring to FIG. 1, FIG. 2, and FIG. 4, the humidifying device of this embodiment includes a shell 10, and an air duct 5 and an air blowing apparatus disposed in the shell 10. A mist outlet channel 11, and an atomizing cavity 3 and a heating cavity 4 communicated with the mist outlet channel 11 are disposed in the shell 10. The air duct includes a first air duct 51 communicated with the atomizing cavity 3 and a second air duct 52 communicated with the heating cavity 4. The air blowing apparatus is provided with an air outlet member 61 for outflow of an air flow, and the air outlet member 61 is aligned with the first air duct 51 and the second air duct 52, and is configured to supply a first air flow to the first air duct 51 and supply a second air flow to the second air duct 52.

Still referring to FIG. 2, the humidifying device of this embodiment further includes a seat 2 and a water tank 1. The water tank 1 is disclosed on the seat 2. The mist outlet channel 11 runs through the water tank 1 and extends from a side where the seat 2 is located to a side far away from the seat 2. The shape of the mist outlet channel 11 is not specifically limited, and the inner diameter of the mist outlet channel 11 may gradually increase from the side where the seat 2 is located to the side far away from the seat 2, or may gradually decrease or vary irregularly.

The following describes the mounting position relationship and specific structures of the air duct 5, the air blowing apparatus, the atomizing cavity 3, the heating cavity 4, the water tank 1, and the seat 2 of the humidifying device.

Figure 3:
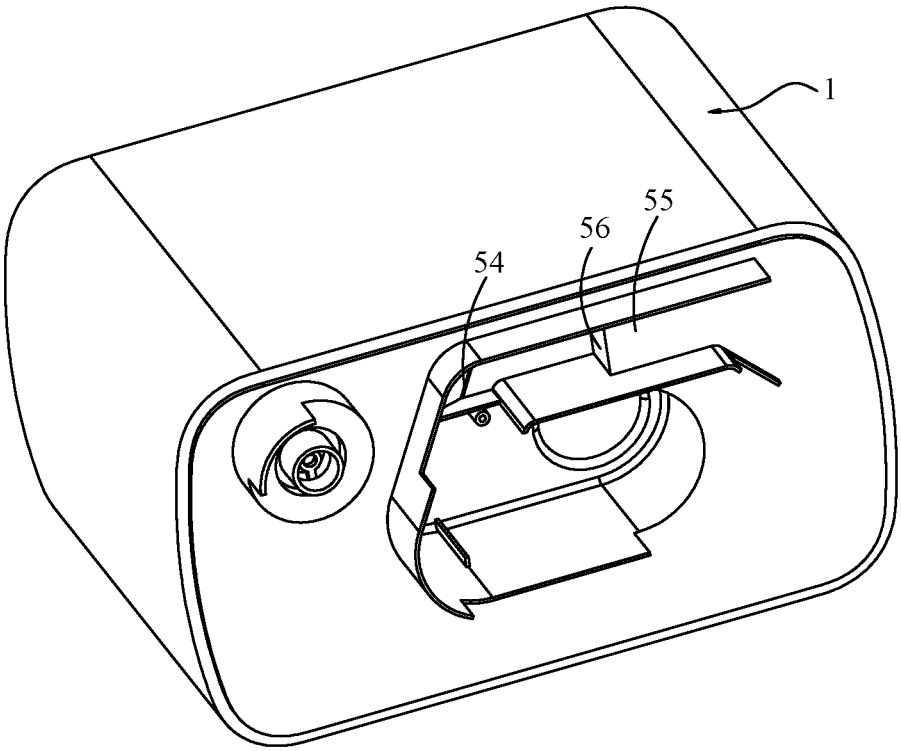
FIG. 3 is a schematic structural diagram of a water tank according to an implementation of FIG. 1.

Referring to FIG. 3 and FIG. 4, the air duct 5 includes a first air duct 51 and a second air duct 52. The air duct 5 has an elongated shape as a whole, and an air outlet member 61 extends into the air duct, so that the air duct is separated by the air outlet member 61 to form a first air duct 51 and a second air duct 52.

Specifically, the air duct is jointly formed by the seat 2 and the water tank 1. The water tank 1 is provided with a water tank bottom wall 12 near a side where the water tank 1 is located. The water tank bottom wall 12 is provided with two spaced air duct partitions 53 protruding toward the side where the seat 2 is located. The air duct partitions 53 and a wall surface of the seat 2 facing the air duct partitions 53 jointly form the air duct 5. The air blowing apparatus is disposed on the seat 2 (referring to FIG. 7), and the air outlet member 61 protrudes from the side of the seat 2 facing the water tank 1 and extends into the air duct, to separate the air duct to form the first air duct 51 and the second air duct 52.

Figure 7:
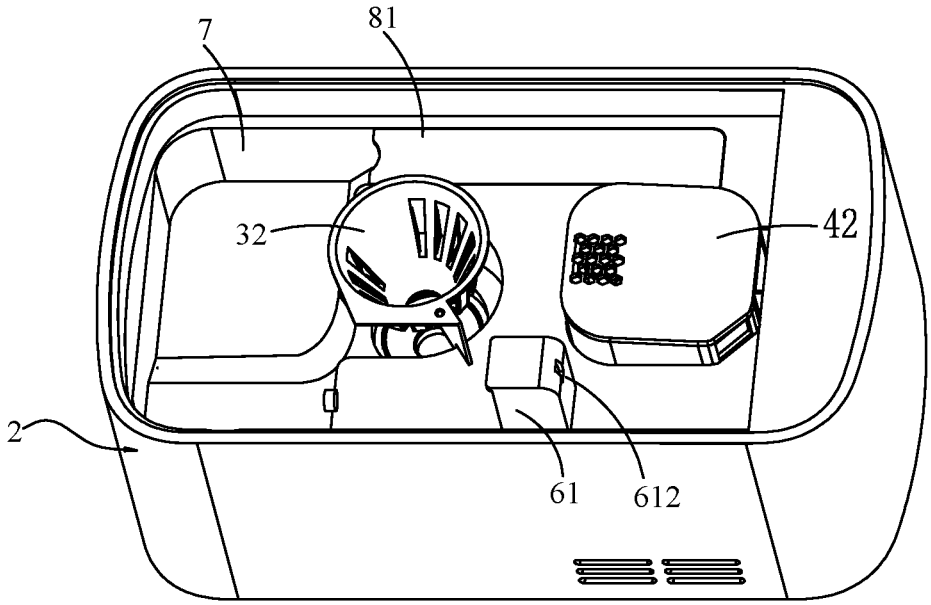
FIG. 7 is a schematic diagram of a partial structure of the humidifying device in FIG. 1 including a seat and a water barrier component.

In combination with FIG. 4 and FIG. 7, the air outlet member 61 is provided with at least one first air outlet 611 and at least one second air outlet 612, the first air outlet 611 is disposed aligned with the first air duct 51 and configured to provide the first air flow to the first air duct 51, and the second air outlet 612 is disposed aligned with the second air duct 52 and configured to provide the second air flow to the second air duct 52. Specifically, the number of the first air outlet 611 and the second air outlet 612 are one and the first air outlet 611 and the second air outlet 612 are respectively disposed on opposite sides of the air outlet member 61. The first air outlet 611 and the second air outlet 612 are arranged along an extending direction of the air duct.

An opening size of the first air outlet 611 is greater than an opening size of the second air outlet 612, so that an air flow rate blown to the atomizing cavity 3 through the first air outlet 611 is greater than an air flow rate blown to the heating cavity 4 through the second air outlet 612, thereby ensuring that the atomizing cavity 3 is the main mist outlet cavity.

Correspondingly, the depth of the first air duct 51 as a whole is greater than that of the second air duct 52 to match the flow rate of air flowing into the first air duct 51 and the second air duct 52. It should be noted that the depth of the first air duct 51 as a whole is greater than that of the second air duct 52, and the depth of all positions of the first air duct 51 is not strictly required to be greater than that of the second air duct 52, the depth of some areas may be greater than that of the second air duct 52, and the depth of some areas may be equal to that of the second air duct 52.

Again referring to FIG. 3 and FIG. 4, in a specific embodiment, the air duct includes a first section 54 and a second section 55, the first section 54 being recessed relative to the second section 55 toward the side away from the seat 2, the air outlet member 61 extends into the first section 54 and is disposed close to the second section 55. In this case, the portion of the first section 54 from the air outlet member 61 to the atomizing cavity 3 forms the first air duct 51, and the second section 55 together with the portion of the first section 54 from the air outlet member 61 to the second section 55 jointly forms the second air duct 52. By disposing the first section 54 to be recessed with respect to the second section 55 toward the side away from the seat 2, a depth of the first air duct 51 as a whole greater than the depth of the first air duct 51 can be obtained, thereby matching the flow rate of air flowing into the first air duct 51 and the second air duct 52.

In addition, as illustrated in FIG. 3, the abutment of the first section 54 and the second section 55 forms a transition surface 56, which extends from the end of the second section 55 toward the side away from the water tank 1, so that the first section 54 is recessed with respect to the second section 55. When the air outlet member 61 is placed in the second section 55, the second air outlet member 612 is aligned with and spaced from the transition surface 56.

Figure 5:
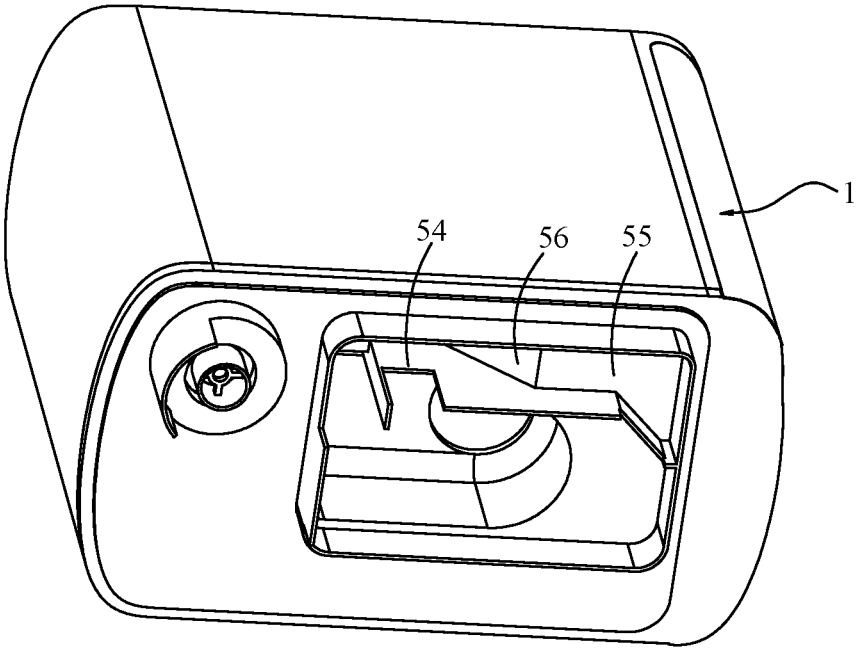
FIG. 5 is a schematic structural diagram of the water tank according to another implementation of FIG. 1.

FIG. 5 illustrates a schematic structural diagram of another water tank in FIG. 3. Referring to FIG. 3, the transition surface 56 may be a vertical plane formed by a vertical recess from the side where the seat 2 is located, or may be, as illustrated in FIG. 5, an inclined plane with a certain slope. Preferably, the inclined plane is inclined inward and extended from the side where the second section 55 is located toward the side where the second section 55 is located.

Referring to FIG. 3 and FIG. 5, the side of the water tank bottom wall 12 facing the seat 2 is further provided with a support plate 57, which is configured to enlarge the support surface between the water tank 1 and the seat 2, so that the water tank 1 is more stable when mounted on the seat 2. The support plate 57 may be provided at an interval with the air duct partition 53 or may be integrally formed therewith, and the support plate 57 and the air duct partition 53 may be integrally formed for convenience of manufacturing.

It should be noted that in the structure of the water tank 1 in FIG. 3, the support plate 57 and the air duct partition 53 form a U-shaped open structure, while in FIG. 5, the support plate 57 and the air duct partition 53 form a closed structure, specifically being disposed in a square shape. However, the shape of the support plate 57 and the air duct partition 53 as a whole is not particularly limited and may be closed or open. When the support plate 57 and the air duct partition 53 form an open structure as shown in FIG. 3, the seat 2 is provided with a protrusion, which abuts against the water tank bottom wall 12, and coordinates with the support plate 57 and the air duct partition 53 to ensure the stability of the installation of the water tank 1 on the seat 2.

In the humidifying device of this embodiment, the air duct partition 53 is disposed on the seat 2, and the air duct 5 is formed by the air duct partition 53, so that the space between the seat 2 and the water tank 1 is fully utilized, and the air outlet member 61 disposed on the seat 2 extends into the air duct 5, so that one air duct is separated into two different air ducts in a simple manner. The structure is simple and the implementation is convenient.

It should be understood that in this embodiment, the first air duct 51 and the second air duct 52 may not be formed by separating one air duct 5, alternatively, the first air duct 51 and the second air duct 52 may be disposed independently and separately, and the positions and numbers of the first air outlet 611 and the second air outlet 612 are not particularly limited, as long as the air flow from the air outlet member 61 can be blown into the first air duct 51 and the second air duct 52 respectively.

Figure 8:
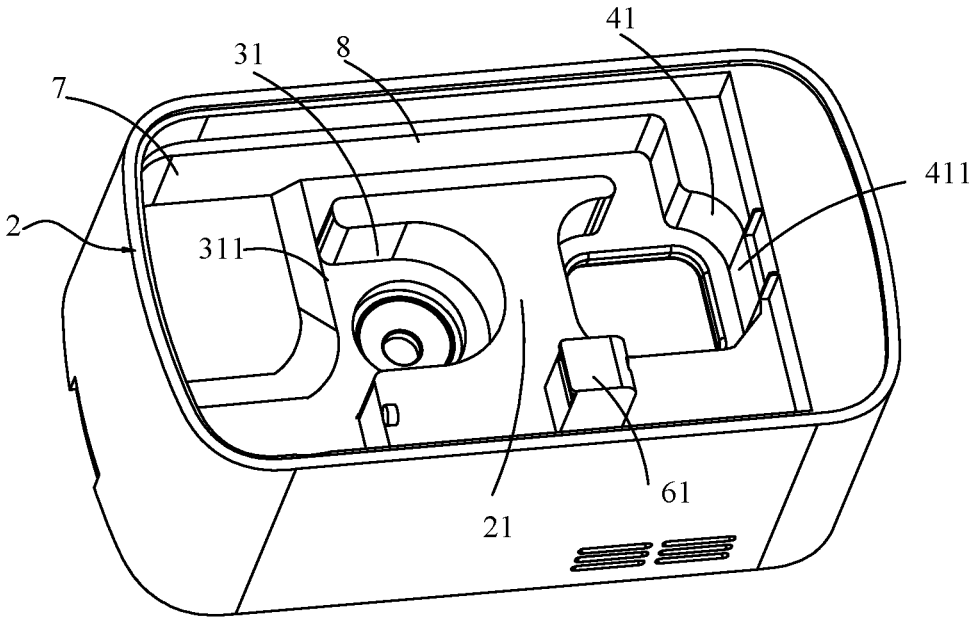
FIG. 8 is a schematic structural diagram of the seat in FIG. 4.

Referring to FIG. 2, FIG. 7 and FIG. 8, the seat 2 is provided with a heating groove 41, the opening of the heating groove 41 faces the side where the water tank 1 is located, the heating groove 41 is covered with a cover 42, and the inner wall of the heating groove 41 and the cover 42 are surrounded to form a heating cavity 4.

The heating cavity 4 is jointly formed by the cover 42 and the heating groove 41, so that steam heated by water can be accumulated in the heating cavity 4 without heat loss, and therefore the utilization rate of hot mist is high. At the same time, due to the isolation effect of the cover 42, the water splashed out from the heating groove 41 can be prevented from leaving the heating cavity 4, thereby protecting other parts of the humidifying device.

Figure 9:
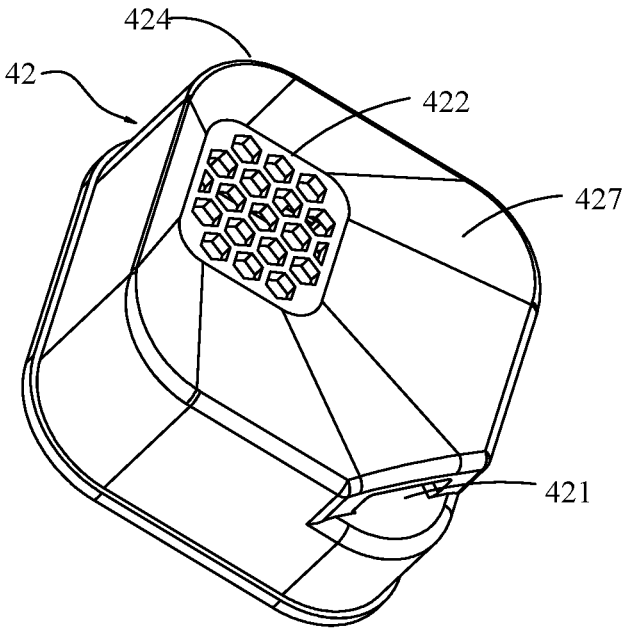
FIG. 9 is a schematic structural diagram of a cover of an implementation of the humidifying device in FIG. 2.
Figure 10:
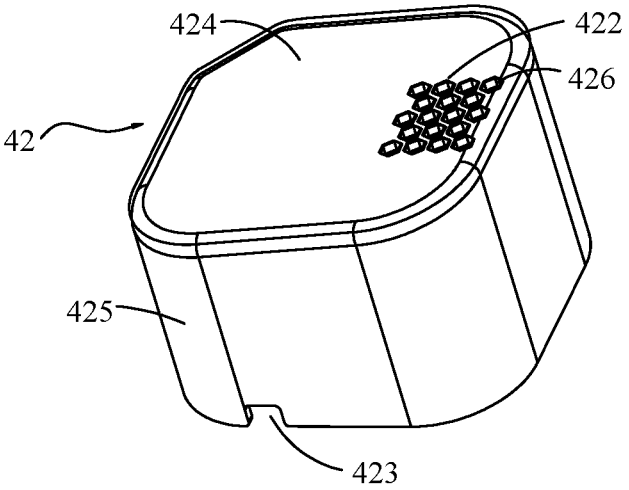
FIG. 10 is a schematic structural diagram of a cover of another implementation of the humidifying device in FIG. 2.

Referring to FIG. 9 and FIG. 10, two different types of covers 42 are illustrated. The shell 42 is provided with a first opening 421, a second opening 422, and a third opening 423. As illustrated in FIG. 2, the first opening 421 is communicated with the second air duct 52, the second opening 422 is communicated with the mist outlet channel 11, and the third opening 423 is configured to supply water to the heating cavity 4. When the humidifying device operates, the second air flow blown from the air outlet member 61 flows into the second air duct 52 from the air outlet member 61, then enters the heating cavity 4 through the first opening 421 to form a heated air flow and then enters the mist outlet channel 11.

The wall surface of the cover 42 away from the heating groove 41 is a top wall of the cover 424, the wall surface in a circumferential direction of the cover 42 is a cover circumferential wall 425, the first opening 421, the third opening 423 are provided on the cover circumferential wall 425, and the second opening 422 is provided on the top wall of the cover 424. The first opening 421 is disposed aligned with the second air duct 52 and the second opening 422 is disposed aligned with the mist outlet channel 11. The third opening 423 is preferably disposed at one side edge of the cover circumferential wall 425 away from the top wall of the cover 424, and the third opening 423 is formed by providing a notch at the edge.

Figure 6:
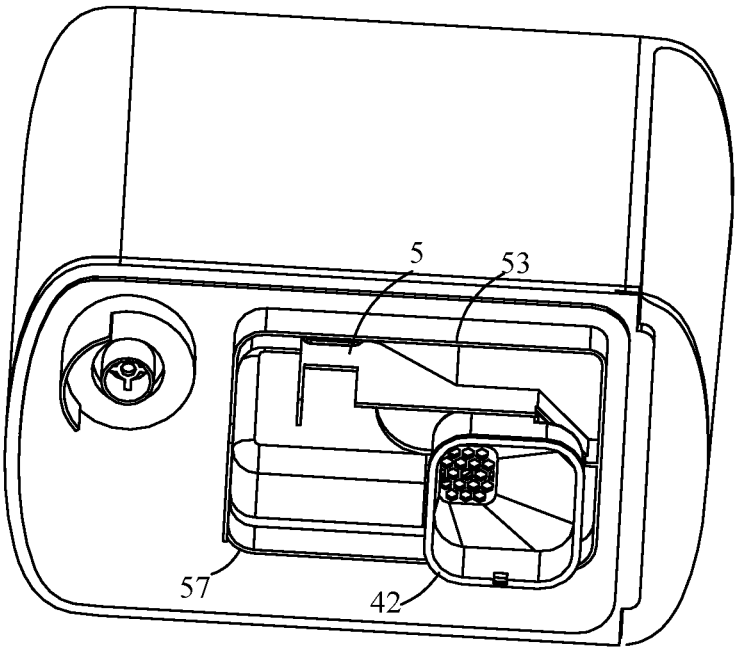
FIG. 6 is a schematic diagram of a partial structure of the humidifying device including the water tank as illustrated in FIG. 5.

Referring to FIG. 6, a specific implementation of disposing the first opening 421 aligned with the second air duct 52 may include: the first opening 421 is aligned with an opening at one end of the second air duct in the longitudinal direction, and the air duct partition 53 is abutted against the circumference of the first opening 421 to reduce the flow of air flow from the circumference of the first opening to the outside of the second air duct 52.

By disposing the second opening 422 aligned with the top wall of the cover 424, the flow rate of the second air flow is increased so that the hot mist can be rapidly blown out.

More specifically, still referring to FIG. 9 and FIG. 10, the second opening 422 includes a plurality of rows of adjacently disposed steam outlets 426 each having an octagonal shape. Preferably, the sum of the opening areas of all steam outlets 426 is less than or equal to one eighth of the area of the top wall of the cover 424, and the number of steam outlets 426 is greater than or equal to ten. In this way, the heated air flow from the heating cavity 4 can be ensured, and the shielding effect of the cover 42 can be sufficiently ensured, so that the noise in boiling water can be reduced by the shielding effect of the cover 42.

Referring to FIG. 9, the top wall of the cover 424 has a surrounding portion 427 that surrounds the second opening 422, and the surrounding portion 427 is arranged obliquely with respect to the vertical direction, so as to guide condensed water on the top wall of the cover 424 and prevent noise caused by direct dripping of the condensed water. It should be understood that, as shown in FIG. 10, the top wall of the cover 424 may alternatively be disposed entirely inclined with respect to the vertical direction, which can also guide the condensed water in the top wall of the cover 424. In this case, the "be disposed inclined with respect to the vertical direction" is based on the position of the cover when the humidifying device is in an operating state.

Referring to FIG. 2, FIG. 7, and FIG. 8, the seat 2 is further provided with an atomizing groove 31, an opening of which faces the side where the water tank 1 is located, and the internal space of the atomizing groove 31 is communicated with the space between the opening of the atomizing groove 31 and the water tank 1 to jointly form an atomizing cavity 3, that is, the atomizing groove 31 forms part of the space of the atomizing cavity 3.

Figure 11:
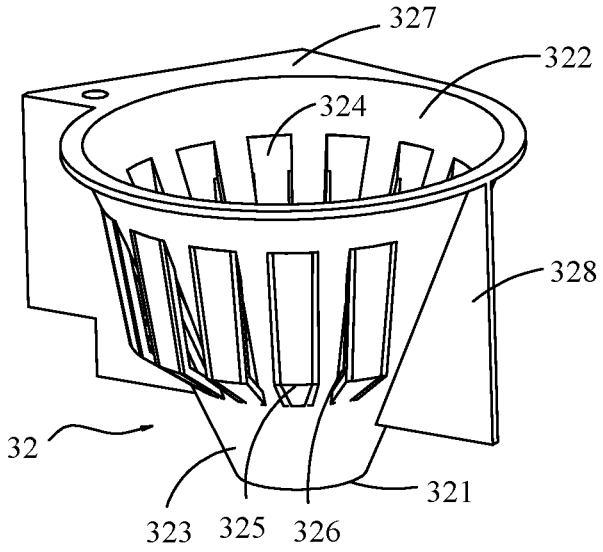
FIG. 11 is a schematic structural diagram of a muffler of the humidifying device in FIG. 2.

As illustrated in FIG. 2 and FIG. 11, the atomizing groove 31 is further provided with a muffler 32. And the muffler 32 is disposed between the seat 2 and the water tank 1. The muffler 32 is funnel-shaped, a smaller opening of the funnel-shaped muffler 32 is a fourth opening 321, a larger opening of the muffler 32 is a fifth opening 322, the fourth opening 321 is aligned with the opening of the atomizing groove 31, and the fifth opening 322 is communicated with the mist outlet channel 11.

The muffler 32 may be fastened to the water tank bottom wall 12, or to the seat. In an implementation, the muffler is fastened to the water tank 1, as illustrated in FIG. 11, in such a manner that a fixing plate 327 extends radially outward from the periphery of the fifth opening 322, and the muffler 32 is fastened to the water tank bottom wall 12 through the fixing plate 327.

It should be noted that since the muffler 32 is disposed between the seat 2 and the water tank 1, a portion of the water tank bottom wall 12 aligned with the atomizing groove 31 is recessed toward a side away from the atomizing groove 31 to facilitate the installation of the muffler 32, thereby forming a receiving space 13, and the receiving space 13 and the atomizing groove 31 jointly form the atomizing cavity 3.

Because a funnel-shaped muffler 32 is arranged above the atomizing groove 31, water droplets excited in the atomization process of the atomizing sheet can slide down along the side wall of the muffler 32, thereby preventing the excited water droplets from directly falling back to the water surface, and better reducing the dripping sound generated in the humidifying process of the humidifying device.

The muffler 32 has a circumferential sidewall 323 which is a wall surface connected between the circumference of the fourth opening 321 and the fifth opening 322 and surrounded in the circumferential direction.

Referring to FIG. 4, at least part of the circumferential sidewall 323 is located inside the air duct 5, a first ventilation hole 324 is provided on the circumferential sidewall 323 located inside the air duct 5, and the air duct 5 is internally communicated with the muffler 32 through the first ventilation hole 324.

The muffler 32 may be coordinated with the air duct 5 by directly be abutted on the air duct partition 53, or in another manner. In an implementation, a circumferential sidewall 323 of the muffler 32 is provided with extension plates 328 spaced away from each other and extending outwards, the two extension plates 328 are respectively abutted on the two air duct partitions 53, so that the muffler 32 is provided at the opening of the first air duct 51 facing the atomizing cavity 3, and that the air flow blown from the first air duct 51 mainly enters through the first ventilation hole 324 of the muffler 32 disposed in the air duct 5, thereby preventing the air flow from being disturbed and making the air flow utilization rate high.

It should be further understood that, in this embodiment, not only the circumferential sidewall 323 of the muffler 32 disposed in the air duct 5 is provided with a first ventilation hole 324, but also the whole circumferential sidewall 323 is provided with a first ventilation hole 324.

The first ventilation holes 324 are provided in an elongated shape extending from the side where the fourth opening 321 is located toward the side where the fifth opening 322 is located, and the width gradually increases in the extending direction.

It should be noted that in order to further enhance the silencing effect of the muffler 32, a baffle 325 is provided at the first ventilation hole 324, the baffle 325 extends from the side where the fourth opening 321 is located toward the side where the fifth opening 322 is located, and both ends of the baffle 325 are respectively connected to both ends of the first ventilation hole 324 Both sides of the baffle 325 are spaced from the circumferential sidewall 323 of the muffler 32, so that a second ventilation hole 326 is formed between the baffle 325 and the circumferential sidewall 323, and the second ventilation hole 326 is communicated with the first ventilation hole 324. The first air flow flowing out of the first air duct 51 enters the muffler 32 through the second ventilation hole 326 and the first ventilation hole 324.

It should be noted that the circumferential sidewall 323 and the baffle 325 of the muffler 32 described above are defined as two different parts. The baffle 325 and the circumferential sidewall 323 are integrally formed. It can be understood that the baffle 325 may not be provided.

A front projection of the baffle 325 on the circumferential sidewall 323 of the muffler 32 can cover the first ventilation hole 324, so that water droplets do not drip directly from the first ventilation hole 324 into the atomizing cavity 3 and generate noise, but flow down the baffle 325. More specifically the baffle 325 is disposed outside the circumferential sidewall 323 and is bent in a V shape. It should be understood that the baffle 325 may be provided in the muffler 32, and the shape of the baffle 325 may be another shape such as an arc shape, which is not specifically limited here, as long as the condensed water can be guided into the atomizing groove 31.

It should be noted that in this embodiment, the muffler 32 and the cover 42 may be provided at the same time, and either of the cover 42 and the muffler 32 may be selected, or both may be provided, which is not particularly limited in this embodiment.

Specific configurations of the atomizing groove 31 and the heating groove 41 are described above, and the specific position relationships of the atomizing groove 31, the heating groove 41, the air outlet member 61, and the air duct are described herein.

Referring to FIG. 8, a raised wall 21 is provided between the atomizing groove 31 and the heating groove 41, and the atomizing groove 31 and the heating groove 41 are separated from each other by the raised wall 21.

The side of the atomizing groove 31 away from the heating groove 41 is a first side 311, the side of the heating groove 41 away from the atomizing groove 31 is a second side 411, and the air outlet member 61 is located between the first side 311 and the second side 411. In this way, the length of the air duct can be shortened, the flow time of the air flow is reduced, and the humidification efficiency is high. Moreover, in this embodiment, the air duct 5 is located at a side of the whole formed by the atomizing groove 31 and the heating groove 41, so that the height space of the humidifying device is not occupied, and the structure is more compact.

It should be pointed out that the position of the air outlet member 61 between the first side 311 and the second side 411 is not strictly disposed in the middle of the first side 311 and the second side 411, but also includes that an orthographic projection of the air outlet member 61 at a vertical connection line between the first side 311 and the second side 411 is located between the first side 311 and the second side 411. In this embodiment, the air outlet member 61 is disposed on one side of an integral body formed by the atomizing groove 31 and the heating groove 41, and is located between the first side 311 and the second side 411.

In this embodiment, the communication groove 8 is disposed on one side of an integral body formed by the atomizing groove 31 and the heating groove 41, and the air outlet member 61 is provided on the other side of the integral body formed by the atomizing groove 31 and the heating groove 41. In this way, the air ducts and the communication grooves 8 are disposed on two sides of the integral body formed by the atomizing grooves 31 and the heating grooves 41, so that the arrangement is quite reasonable, and the internal space of the humidifying device shell 10 is saved.

Still referring to FIG. 8, the seat 2 is further provided with a water groove 7 configured to supply water to the heating groove 41 and the atomizing groove 31, and an opening of the water groove 7 faces the side where the water tank 1 is located. The water groove 7, the atomizing groove 31, and the heating groove 41 are arranged in sequence, that is, the atomizing groove 31 is arranged between the water groove 7 and the heating groove 41. The atomizing groove 31 is open toward one side of the water groove 7 and is directly communicated with the water groove 7. A communication groove 8 is disposed between the heating groove 41 and the water groove 7.

Referring to FIG. 7 and FIG. 10, the third opening 423 provided in the cover 42 is disposed aligned with the communication groove 8, one end of the communication groove 8 is communicated with the water groove 7, and the other end of the communication groove 8 is communicated with the heating groove 41 through the third opening 423, so that the heating groove 41 and the water groove 7 are communicated with each other through the communication groove 8.

Figure 12:
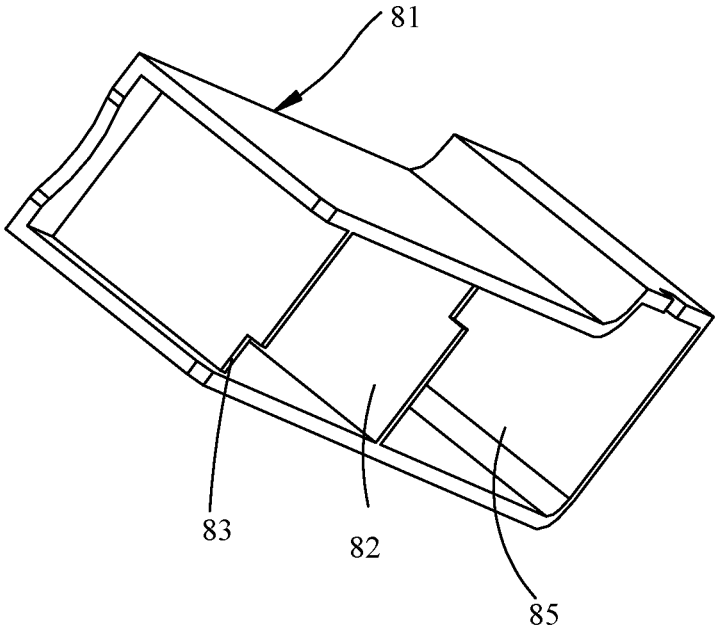
FIG. 12 is a schematic structural diagram of the water barrier component in FIG. 7.

As illustrated in FIG. 12, a water barrier component 81 is disposed in the communication groove 8, the water barrier component 81 includes at least two water barriers 82, the water barriers 82 are arranged at intervals along an extending direction of the communication groove 8, and one end of each water barrier 82 near a bottom of the communication groove 8 is provided with a water passing hole 83 for water to flow through. An opening area of the water passing hole 83 is less than or equal to that of the third opening 423 of the cover 42, so that the water passing hole 83 can function as a flow restriction on water.

In this embodiment, the water passing holes 83 of two adjacent water barriers 82 are disposed in a staggered manner. The staggered position may be understood as the direction in which the connection line between the two adjacent water passing holes 83 is located is inclined with respect to the extending direction of the communication groove 8 located in the portion between the two water barriers 82. The water passing holes 83 of two adjacent water barriers 82 may alternatively not be disposed in a staggered manner.

To facilitate the installation of the water barrier 82, the water barrier component 81 further includes a mounting member 84, which can be accommodated in the communication groove 8 and has a shape adapted to the shape of the communication groove 8. A mounting groove 85 is provided in the mounting member 84, and the water barriers 82 are fixedly disposed in the mounting groove 85 and sequentially arranged along the extending direction of the mounting groove 85. The water passing hole 83 of the water barrier 82 is disposed close to the opening of the mounting groove 85. When the water barrier component 81 is mounted in the communication groove 8, the opening of the mounting groove 85 is disposed toward the bottom of the communication groove 8.

By disposing the water barrier component 81, the amount of water flowing into the heating groove 41 from the water groove 7 can be controlled, to prevent the boiled water in the heating groove 41 from flowing back into the atomizing groove 31, thereby causing the atomizing sheet in the atomizing groove 31 to be damaged due to an increase in temperature. In addition, an integral body formed by the mounting member 84 and the water barrier 82 is mounted in the communication groove 8, and the water barrier 82 can be conveniently removed, cleaned, and replaced.

The following describes the working principle of the humidifying device of this embodiment as a whole.

The water in the water groove 7 enters the atomizing groove 31. The atomizing groove 31 atomizes the water. The air flow is blown out from the first air outlet 611 of the air outlet member 61 to form a first air flow and enters the first air duct 51. The first air flow enters the muffler 32 through the first ventilation hole 324 and the second ventilation hole 326 of the muffler 32 to form an atomized air flow and then enters the mist outlet channel 11 through the fifth opening 322.

At the same time, the water in the water groove 7 enters the heating groove 41, the heating groove 41 heats the water, the air flow is blown out from the second air outlet 612 of the air outlet member 61 to form a second air flow into the second air duct 52, the second air flow enters the atomizing cavity 3 from the second air duct 52 through the first opening 421 in the cover 42 to form a heated air flow, and the heated air flow enters the mist outlet channel 11 from the third opening 423 in the cover 42.

Further, the atomized air flow and the heated air flow are mixed in the mist outlet channel 11 and are finally sprayed out from the humidifying device.

The humidifying device of the first embodiment of the present invention is shown above and a humidifying device of a second embodiment is further provided.

Figure 13:
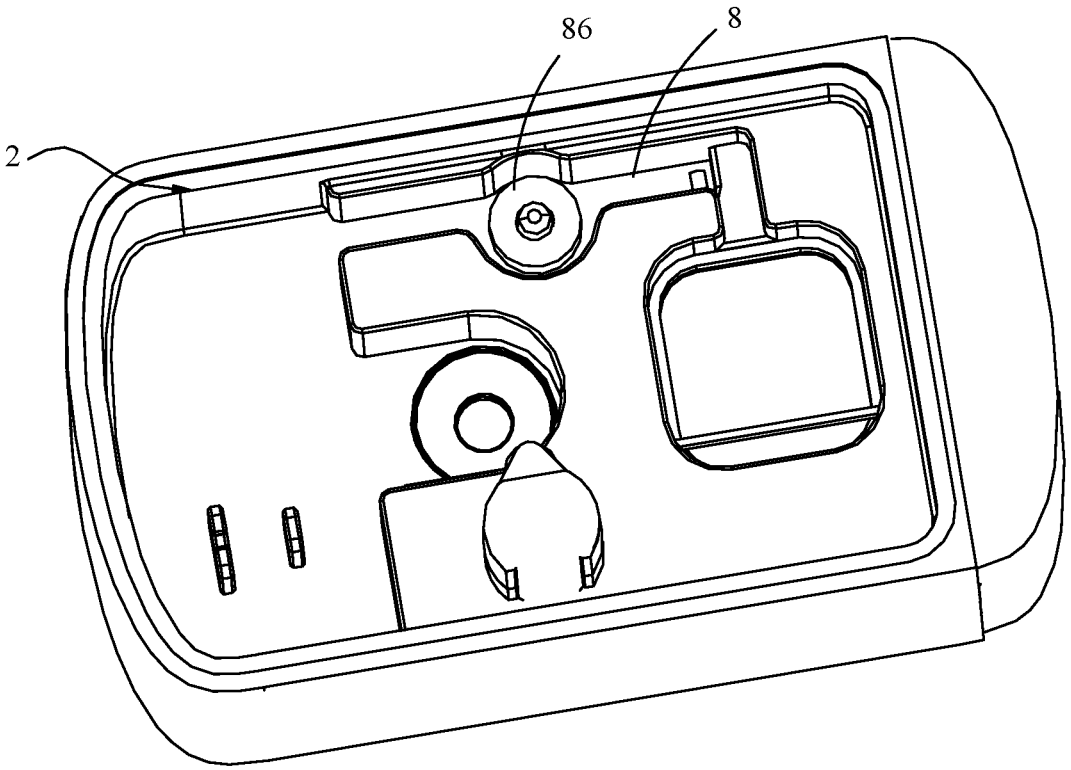
FIG. 13 is a schematic structural diagram of a seat according to a second embodiment of the present invention.

The structure in this embodiment is substantially the same as that in the first embodiment. As illustrated in FIG. 13, the difference is merely lies in that the communication groove 8 is further provided with a water level measurement apparatus 86, configured to measure a water level in the communication groove 8.

Since the water in the heating groove 41 is supplied by the water groove 7 and the water groove 7 is disposed closer to the atomizing groove 31 as compared with the heating groove 41, it is inevitable that there may be water in the atomizing groove 31 first. When there is no water in the heating groove 41, in this embodiment, the water level measurement apparatus 86 is disposed in the communication groove 8 instead of in the water groove 7, so as to prevent the situation in which the humidifying device starts to operate when there is water in the atomizing groove 31 close to the water groove 7 and there is no water in the heating groove 41, thus causing dry burning in the heating groove 41.

Preferably, the water level measurement apparatus 86 is provided closer to the heating groove 41 as compared with the water groove 7.

The water level measurement apparatus 86 is disposed between two adjacent water barriers 82. By disposing the water level measurement apparatus 86 between two adjacent water barriers 82, the measured water level is ensured to be the water level after flow restriction through the water passing hole 83 and is less affected by water level fluctuations in the water groove 7 and the heating groove 41.

In this embodiment, the water level measurement apparatus 86 includes a reed tube and a floating ring sleeved on the reed tube, and the reed tube is fixedly disposed at the bottom of the communication groove 8. The water level measurement apparatus 86 may alternatively not be in the form of a reed tube or a floating ring or may be in other ways and is not specifically limited herein.

Figure 14:
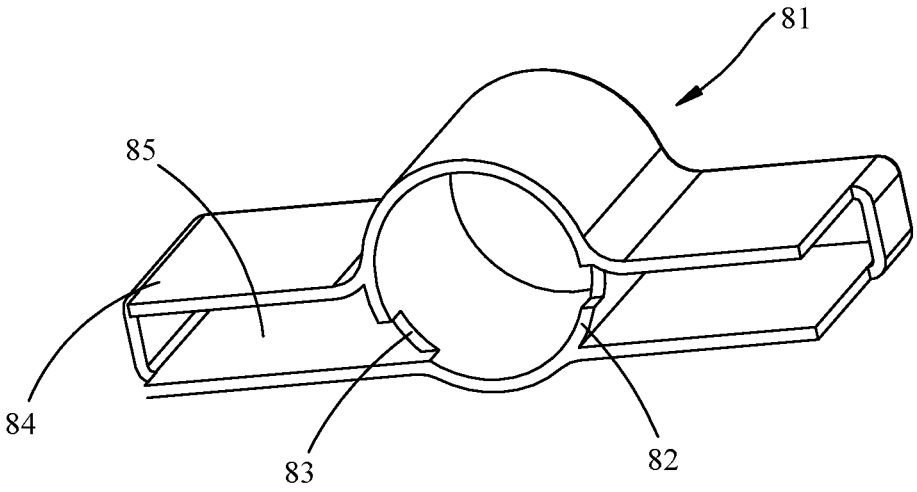
FIG. 14 is a schematic structural diagram of a water barrier component according to a second embodiment of the present invention.

Referring to FIG. 14, when the mounting member 84 is provided, the wall surfaces of the two water barriers 82 between which the water level measurement apparatus 86 is provided and the mounting member 84 between the two water barriers 82 are disposed in a circular shape, so as to facilitate the placement of the water level measurement apparatus 86.

An embodiment of this application further provides a humidifying device according to a third embodiment.

Figure 15:
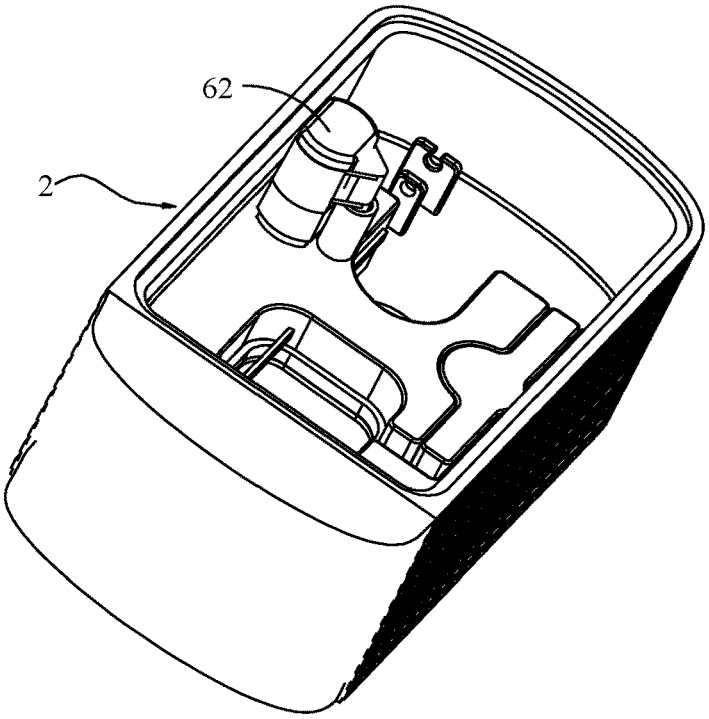
FIG. 15 is a schematic diagram of a partial structural of a humidifying device according to a third embodiment of the present invention, wherein a seat of the humidifying device is provided with a waterproof apparatus.

Referring to FIG. 15, the structure of this embodiment is substantially the same as that of the second embodiment, and the difference merely lies in that the air blowing apparatus further includes a waterproof component 62.

Figure 16:
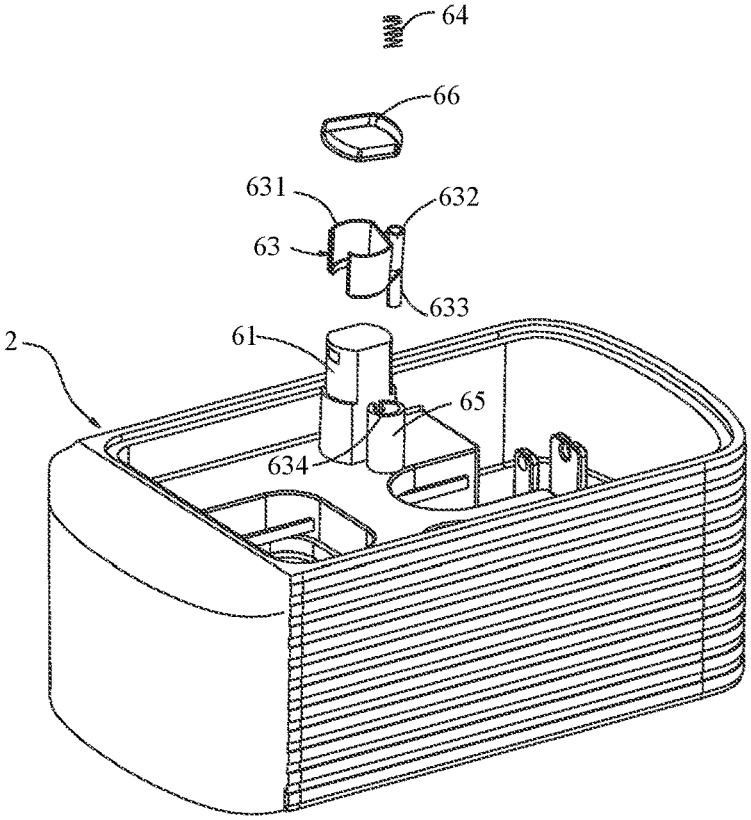
FIG. 16 is a schematic view of an exploded structure of FIG. 15, wherein the waterproof apparatus includes a waterproof member.

As illustrated in FIG. 16, the waterproof component 62 includes a waterproof member 63 and an elastic support member 64. The waterproof member 63 is supported on the elastic support member 64 and covers air outlets of the air outlet member 61 for air discharging. The air outlets are the first air outlet 611 and the second air outlet 612. The waterproof member 63 is movable under a force to open the air outlet and enable the elastic support member 64 to be deformed; and after the force applied to the waterproof member 63 is removed, the elastic support member 64 recovers deformation to drive the waterproof member 63 to move until covering the air outlet.

The air blowing apparatus is disposed on the seat 2. The waterproof member 63 includes a waterproof portion 631 for covering or blocking an air outlet position of the air outlet member 61 and a connection portion 632 connected to a side of the waterproof portion 631. One end of the elastic support member 64 is abutted on the seat 2, and the other end of the elastic support member 64 is abutted on the connection portion 632. The waterproof component 62 further includes a guide member 65. The guide member 65 is disposed around an outer side of the elastic support member 64, to provide guide for movement of the elastic support member 64 or the connection portion 632.

The guide member 65 in this embodiment is fixedly disposed on the seat 2, and the elastic support member 64 is a spring disposed in the guide member 65. A first guide hole 634 is formed in the guide member 65.

The waterproof portion 631 is U-shaped and has a connecting wall (not numbered) and a blocking wall (not numbered) extending toward the same side opposite to the connecting wall. The waterproof portion 631 covers part of a circumferential surface of the air outlet member 61, and the two blocking walls respectively cover the first air outlet member 611 and the second air outlet member 612.

The connection portion 632 is connected to the connecting wall, and a guide section 633 is disposed on the side facing the seat 2. The guide section 633 is inserted into the first guide hole of the guide member 65 and abuts on the elastic support member 64. The guide section 633 is adapted to the shape of the first guide hole 634 of the guide member 65 and can move along the length direction of the guide member 65.

Figure 17:
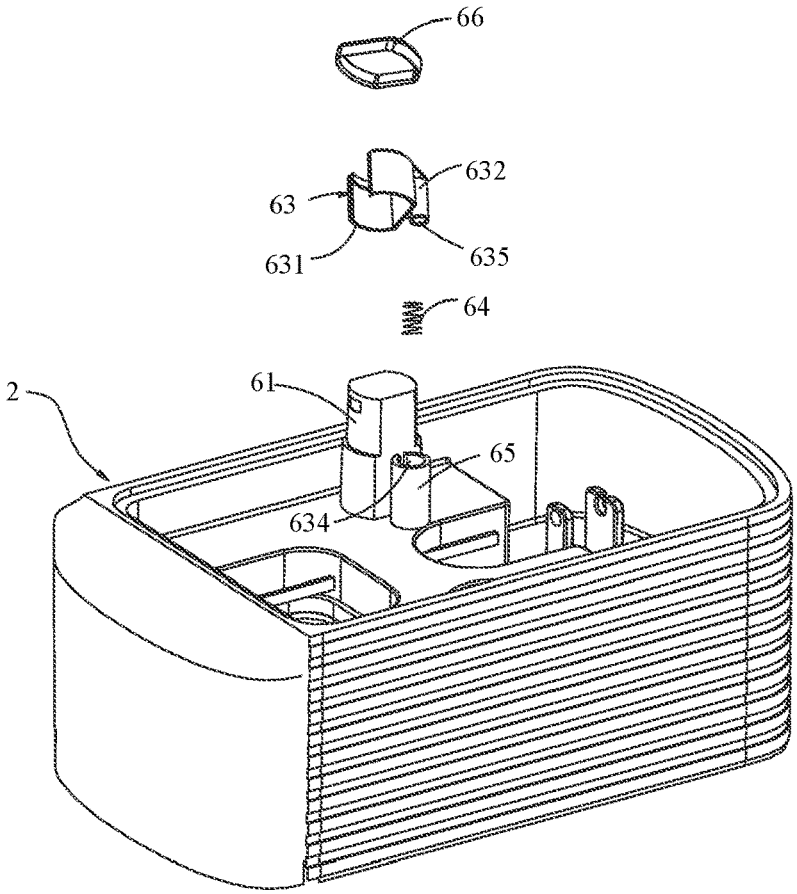
FIG. 17 is a schematic view of an exploded structure according to another embodiment of FIG. 15, wherein the structure of the waterproof member is different from that of the waterproof member in FIG. 16.

The waterproof member 63, the elastic support member 64, and the guide member 65 are coordinated in a variety of ways, which is not specifically limited herein. FIG. 17 illustrates another coordinating manner of the waterproof member 63, the elastic support member 64, and the guide member 65. In the coordination mode, the connection portion 632 does not include a guide section 633, and instead, a second guide hole 635 is provided on the side away from the water tank 1. The elastic support member 64 is partially accommodated in the second guide hole 635, and the connection portion 632 is accommodated in the first guide hole 634, so as to be slidable along the length direction of the guide member 65. In this case, one end of the elastic support member 64 is abutted on the bottom wall of the first guide hole 634, and the other end of the elastic support member 64 is abutted on the bottom wall of the second guide hole 635. In the implementation, at least part of the surface of the connection portion 632 is shaped to fit with the first guide hole 634 of the guide member 65, so that the connection portion is movable along the length direction of the guide member 65.

The side of the air outlet member 61 away from the seat 2 is further provided with a limit member 66, which is fixedly disposed on the air outlet member 61 to prevent the waterproof member 63 from being separated from the air outlet member 61. Specifically, the limit member 66 has a cover-like structure, which is covered on the air outlet member 61, and part of the inner wall surface of the cover-like structure is in interference fit with part of the circumferential surface of the air outlet member 61. However, there are many ways of fastening the limit member 66 and the air outlet member 61, which are not specifically limited herein.

Figure 18:
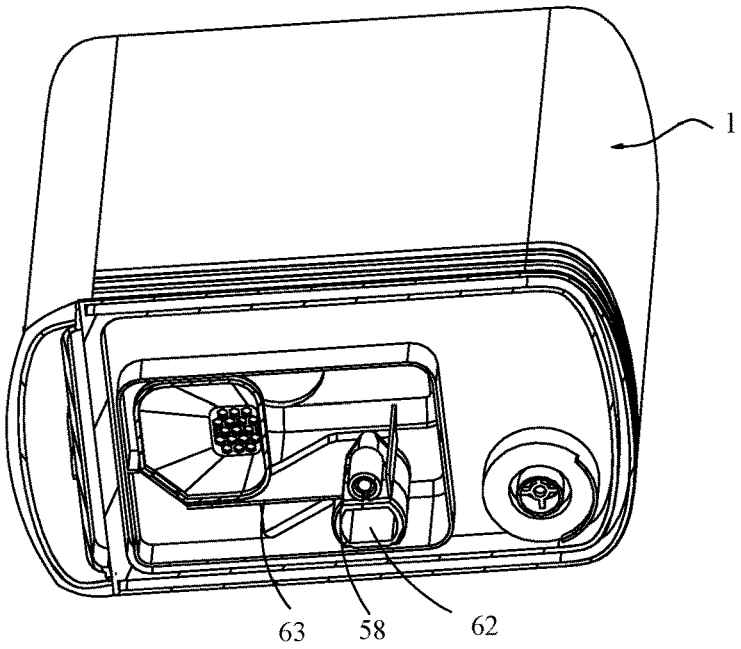
FIG. 18 is a schematic diagram of the coordinated structure between the waterproof apparatus and the water tank in FIG. 15.

Referring to FIG. 18, in order to facilitate the application of force to the waterproof member 63 when the water tank 1 is placed on the seat 2, a protrusion (not numbered) may be provided at a position corresponding to the waterproof member 63 on the water tank 1, and the force is applied to the waterproof member 63 through the protrusion. In a preferable embodiment, a force is applied on the waterproof member 63 by using the air duct partition 53.

Specifically, one of the air duct partitions 53 is disposed aligned with the waterproof member 63 and more specifically with the connection portion 632 of the waterproof member 63. A notch 58 is provided in an air duct partition 53 aligned with the waterproof member 63 for receiving the waterproof member 63 when the air outlet member 61 extends into the air duct 5.

In this embodiment, the waterproof member 63 is provided to prevent water from entering into the seat 2 from the air outlets (the first air outlet member 611 and the second air outlet member 612) during the process of cleaning the seat 2 of the humidifying device. Since the circuit board is provided in the seat 2, the short circuit of the circuit board due to humidity can be prevented, and the service life of the circuit board can be prolonged. At the same time, the elastic support member 64 is further provided, so that when the water tank 1 is placed on the seat 2, the water tank 1 can press the waterproof member 63 to move toward the side where the elastic support member 64 is located, so that the elastic support member 64 is deformed, and the air outlet is opened, which is convenient to operate.

An embodiment of this application further provides a humidifying device according to a fourth embodiment.

The structure of this embodiment is substantially the same as that of the first embodiment, and the difference merely lies in that the air blowing apparatus further includes a waterproof component 62. The structure of the waterproof component 62 has been described in the third embodiment and is not described herein.

To sum up, by disposing the first air duct 51 and the second air duct 52 in the humidifying device of this application, the air flow from the air outlet member 61 does not appear turbulence, and the water steam and water mist can be quickly mixed, so that the mist discharge efficiency is high. Moreover, because the air flow from the air outlet 61 does not have turbulence, the temperature uniformity of the mist discharged from the humidifying device is better. In addition, the humidifying device of this application is provided with a second air duct 52 communicated with the heating cavity 4, to enable the humidifying device to have an independent air duct to blow out the water steam generated by heating at the heating cavity 4 to the mist outlet channel 11, so that the water mist atomized in the atomizing cavity 3 can be quickly heated when the humidifying device starts operating, that is, the hot mist can be quickly discharged. At the same time, there is a large amount of hot mist in the continuous operating process of humidifying device.

The foregoing embodiments are merely illustrative of several implementations of this application and the description thereof is more specific and detailed, but cannot therefore be construed as limiting the scope of this application. It should be noted that several modifications and modifications may be made by those of ordinary skill in the art without departing from the concept of this application, all of which fall within the protection scope of this application. Therefore, the protection scope of this application shall be subject to the appended claims.

What is claimed is:

1. A humidifying device, comprising:

a shell, wherein a mist outlet channel, an atomizing cavity and a heating cavity communicated with said mist outlet channel are disposed in said shell;

an air duct, disposed in said shell and comprising a first air duct communicated with said atomizing cavity and a second air duct communicated with said heating cavity;

an air blowing apparatus, disposed in said shell and provided with an air outlet member for outflow of an air flow, wherein said air outlet member is configured to provide a first air flow to said first air duct and a second air flow to said second air duct, wherein when said humidifying device operates, said first air flow enters said atomizing cavity through said first air duct to form an atomized air flow, said second air flow enters said heating cavity through said second air duct to form a heated air flow, and then said atomized air flow and said heated air flow enter said mist outlet channel, and are mixed in said mist outlet channel and sprayed out from said humidifying device, wherein said air outlet member is provided with at least one first air outlet and at least one second air outlet, said first air outlet is disposed aligned with said first air duct to provide said first air flow to said first air duct, and said second air outlet is disposed aligned with said second air duct to provide said second air flow to said second air duct, said air outlet member extending into said air duct, said air duct being separated by said air outlet member to form said first air duct and said second air duct, said first air outlet facing a side where said first air duct is located, and said second air outlet facing a side where said second air duct is located.

2. The humidifying device according to claim 1, wherein an opening size of said first air outlet is greater than an opening size of said second air outlet.

3. The humidifying device according claim 2, comprising a seat and a water tank, wherein said water tank is disposed on said seat, and said seat is provided with an atomizing groove forming a partial space of said atomizing cavity and a heating groove forming a partial space of said heating cavity;

openings of said atomizing groove and said heating groove all face a side where said water tank is located; and said air outlet member protrudes from a side of said seat facing said water tank.

4. The humidifying device according to claim 3, wherein said water tank is provided with a bottom wall of said water tank near said side where said seat is located, said bottom wall of said water tank is provided with at least two spaced air duct partitions protruding toward said side where said seat is located, and said air duct partitions and a wall surface of said seat facing said air duct partitions jointly form said air duct.

5. The humidifying device according to claim 3, wherein said air blowing apparatus further comprises a waterproof component, said waterproof component comprises a waterproof member and an elastic support member, and said waterproof member is supported on said elastic support member and covers an air outlet of said air outlet member for air discharging;

said waterproof member is movable under a force to open said air outlet and enable said elastic support member to be deformed; and after said force applied to said waterproof member is removed, said elastic support member recovers to drive said waterproof member to move until covering said air outlet.

6. The humidifying device according to claim 5, wherein said waterproof member comprises a waterproof portion for covering an air outlet position of said air outlet member and a connection portion connected to a side of said waterproof portion; one end of said elastic support member is abutted on said seat, and the other end of said elastic support member is abutted on said connection portion; and said waterproof component further comprises a guide member, wherein said guide member is disposed around an outer side of said elastic support member.

7. The humidifying device according to claim 3, further comprising a cover disposed on said heating groove, and an inner wall of said heating groove and said cover jointly form said heating cavity; and said cover is provided with a first opening and a second opening, wherein said first opening is communicated with said second air duct, and said second opening is communicated with said mist outlet channel.

8. The humidifying device according to claim 7, wherein a wall of said cover far away from said heating groove is a top wall of said cover, and said second opening is disposed on said top wall of said cover; and said top wall of said cover is provided with a surrounding portion disposed around said second opening, and said surrounding portion is disposed obliquely relative to a vertical direction; or said top wall of said cover entirely is disposed obliquely relative to a vertical direction.

9. The humidifying device according to claim 3, wherein said atomizing groove is further provided with a muffler; and said muffler is funnel-shaped, a smaller opening of said funnel-shaped muffler is a fourth opening, a larger opening of said muffler is a fifth opening, said fourth opening is aligned with said opening of said atomizing groove, and said fifth opening is communicated with said mist outlet channel.

10. The humidifying device according to claim 9, wherein said muffler has a circumferential sidewall, at least part of which is located inside said air duct, a first ventilation hole is provided on said circumferential sidewall located inside said air duct, and said first air duct is internally communicated with said muffler through said first ventilation hole.

11. The humidifying device according to claim 3, wherein said seat is further provided with a water groove and a communication groove, said water groove is configured to supply water to said heating groove, said communication groove communicates said heating groove and said water groove, and said communication groove is further provided with a water level measurement apparatus configured to measure a water level in said communication groove.

12. The humidifying device according to claim 11, wherein a water barrier component is disposed in said communication groove, said water barrier component comprises at least two water barriers, said water barriers are arranged at intervals along an extending direction of said communication groove, and one end of each said water barrier near a bottom of said communication groove is provided with a water passing hole for water to flow through; and said water level measurement apparatus is disposed between two adjacent water barriers.

* * * * *